United States Patent [19]

Roberge

[11] Patent Number: 4,983,982

[45] Date of Patent: Jan. 8, 1991

[54] SPACE FED PHASED ARRAY ANTENNA WITH DUAL PHASE SHIFTER

[75] Inventor: Raymond A. Roberge, Stow, Mass.

[73] Assignee: Raytheon Company, Lexington, Mass.

[21] Appl. No.: 422,170

[22] Filed: Oct. 16, 1989

[51] Int. Cl.[5] ..... H01Q 3/00

[52] U.S. Cl. ..... 342/376

[58] Field of Search ..... 342/81, 376, 42; 343/754

[56] References Cited

U.S. PATENT DOCUMENTS

| | | | |
|---|---|---|---|
| 3,305,867 | 2/1967 | Miccioli et al. | 343/113 |
| 3,569,974 | 3/1971 | McLeod, Jr. | 343/754 |
| 3,588,901 | 6/1971 | Buck | 343/741 |
| 4,388,626 | 6/1983 | Gans | 343/754 |
| 4,488,155 | 12/1984 | Wu | 342/376 |
| 4,588,994 | 5/1986 | Tang et al. | 343/754 |

*Primary Examiner*—Theodore M. Blum

*Attorney, Agent, or Firm*—Donald F. Mofford; Richard M. Sharkansky

[57] ABSTRACT

An array antenna for a radar is shown in include a phase shifter arrangement wherein, in the transmitting mode, ferrite phase shifters are used to collimate and direct a beam of transmitted radio frequency energy originating at a feed horn and, in the receiving mode, amplifiers and diode phase shifters are used to amplify and to focus received radio frequency energy on a feed horn.

7 Claims, 2 Drawing Sheets

SPACE FED PHASED ARRAY ANTENNA WITH DUAL PHASE SHIFTER

BACKGROUND OF THE INVENTION

This invention pertains generally to phased array antennas, and particularly to space fed phased array antennas used in radar systems.

It is known in the art that a space fed phased array antenna may be used to advantage in ground-to-air defense systems, such as the system called "PATRIOT," (a registered trademark of the Government of the United States of America). Thus, in the PATRIOT system, a control radar utilizing a first space fed phased array antenna is arranged to illuminate a target (say an attacking aircraft) and to receive echo signals directly reflected from the target and a second antenna is arranged to receive signals retransmitted from a guided missile (referred to hereinafter as the "missile") in flight to intercept the target, such retransmitted signals being analogous to echo signals at the missile. Both the echo signals and the retransmitted signals then are processed to derive guidance command signals that are passed through the second phased array antenna to the missile, ultimately to cause the course of the missile to be adjusted as required to ensure interception of the target. Because of the high levels of radio frequency energy passing through both the first and the second space fed array antennas in the PATRIOT system, controllable ferrite phase shifters are used to determine the phase distribution across the radiating elements making up each one of such antennas. The use of controllable ferrite phase shifters (which are nonreciprocal devices) requires that the control signals for each ferrite phase shifter be changed when the radar is transmitting or receiving radio frequency energy. Further, the noise figure of the radar is degraded by the insertion loss of each one of the ferrite phase shifters. Such loss is particularly important when echo signals are being received.

SUMMARY OF THE INVENTION

With the foregoing background of the invention in mind, it is a primary object of this invention to provide a phase shifter arrangement for use in a phased array antenna in a radar, such arrangement being optimized for both the transmitting and the receiving mode of operation.

Another object of this invention is to provide a phase shifter arrangement for use in a phased array antenna in a radar, the insertion loss of such arrangement being kept at a minimum.

Still another object of this invention is to provide a phase shifting arrangement adapted to permit performance of the foregoing when signals at widely differing frequencies are received.

The foregoing and other objects of this invention are generally attained in a radar in a missile by providing, for use with each radiating element in a phased array antenna incorporated in the radar, a phase shifter arrangement utilizing ferrite phase shifters (when the radar is in the transmitting mode) and diode phase shifters (when the radar is in the receiving mode) with the result that a reciprocal phase shifter arrangement is formed. The noise figure of the radar is improved by providing amplifiers for received signals before such signals are applied to the diode phase shifters.

BRIEF DESCRIPTION OF THE DRAWINGS

For a more complete understanding of this invention, reference is now made to the following description of the accompanying drawings wherein.

DESCRIPTION OF THE PREFERRED EMBODIMENT

Figure 1:
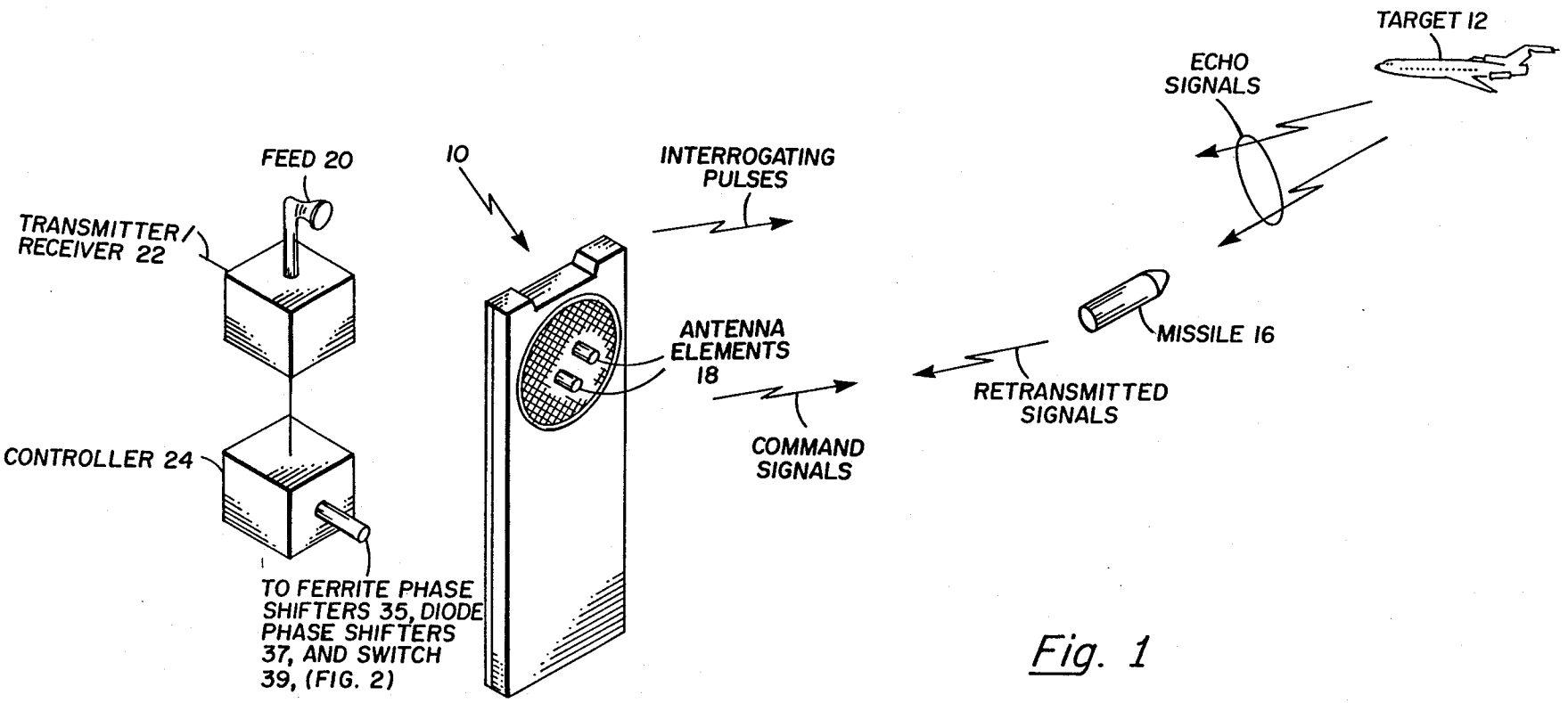
FIG. 1 is a sketch illustrating phase shifter arrangements according to this invention in a radar in a ground-to-air defense system.

Referring now to FIG. 1, it may be seen that a space fed antenna 10 according to this invention is actuated to transmit: (a) interrogating pulses of radio frequency energy (referred to hereinafter simply as "interrogating pulses") at a first frequency; and (b) command signals of radio frequency energy (referred to hereinafter simply as "command signals") at a second frequency. The space fed antenna 10 is also actuable to receive: (a) echo signals from an aircraft (hereinafter referred to as "target 12"), the frequency of the echo signals being at the first frequency, shifted by the Doppler effect; and (b) retransmitted signals indicative of the echo signals received by appropriate known equipment (not shown) on a missile 16 in flight to intercept the target 12, the frequency of the carrier of the retransmitted signals here being different from the first frequency or the frequency of echo signals.

The space fed antenna 10 here is made up of an array of antenna elements such as the antenna elements 18 illustrated in FIG. 2 and described hereinafter. It will be appreciated that each one of the antenna elements 18 in the array of antenna elements is actuated in the transmitting mode to collimate and direct radio frequency energy from a feed 20, thereby to form a beam (not shown) of radio frequency energy directed toward the target 12. A transmitter/receiver 22, in response to signals from a controller 24, is operative to form pulses of radio frequency energy for transmission and to process received radio frequency energy. The beam is directed toward the missile 16 when command signals are to be transmitted. In the receiving mode the beam is directed toward the target 12 when echo signals are to be received or toward the missile 16 when retransmitted signals are to be received. For a more complete explanation of the principles of operation and structure to scan a beam from a space fed array antenna, reference is made to U.S. Pat. No. 3,305,867, which patent is assigned to the same assignee as this application.

Figure 2:
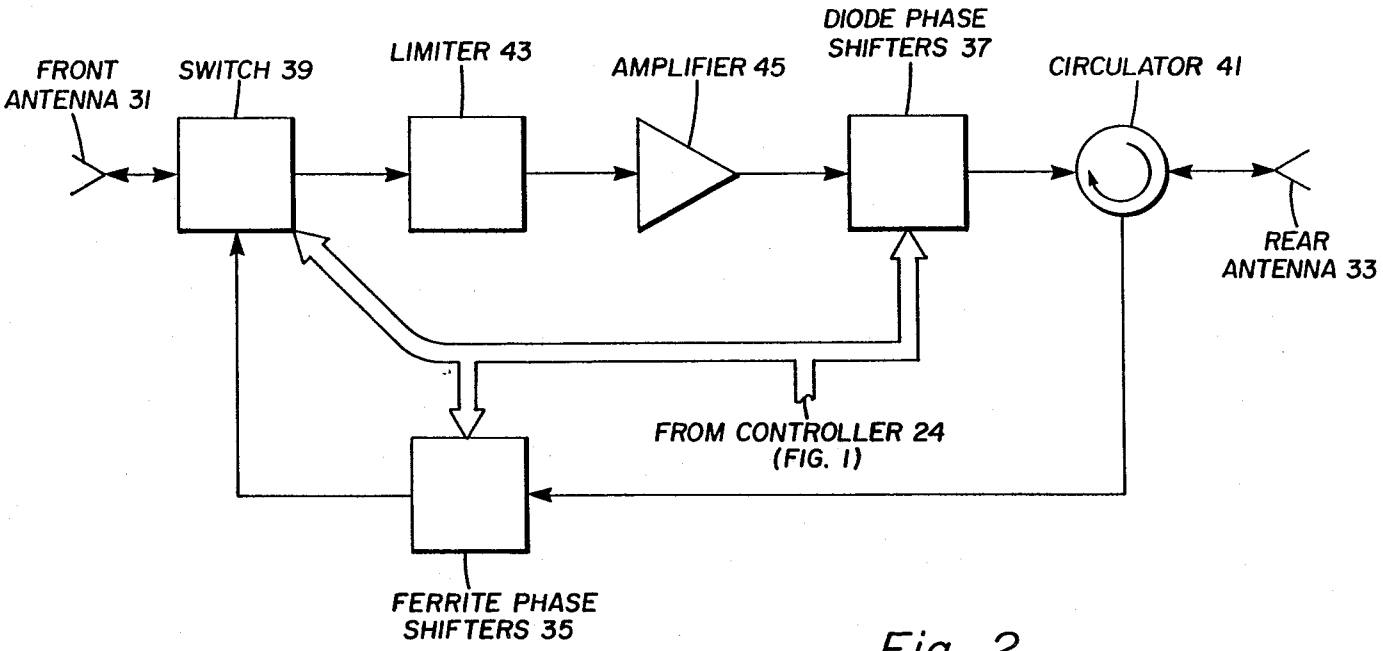
FIG. 2 is a block diagram of an embodiment of a typical one of the phase shifter arrangements shown in FIG. 1.

Referring now to FIG. 2, details are shown of an exemplary one of the antenna elements 18 (FIG. 1) that is here contemplated to replace each one of the antenna elements in a space fed array antenna such as the antenna shown in U.S. Pat. No. 3,305,867. Thus, in addition to a front antenna 31 and a rear antenna 33, the exemplary one of the antenna elements 18 (FIG. 1) illustrated in FIG. 2 provides different phase shifters in the signal path of radio frequency energy when transmitting or receiving. As indicated, ferrite phase shifters 35 are used in the transmitting mode and diode phase shifters 37 are used in the receiving mode. Switching between the phase shifters is accomplished by a switch 39 and a circulator 41 that are connected as shown to operate as a double-pole, double-throw switch. In the transmitting mode, the ferrite phase shifters 35 are connected between the rear antenna 33 and the front antenna 31; and (b) in the receiving mode, the diode phase shifters 37 (along with a limiter 43 and an amplifier 45) are connected between the front antenna 31 and the rear antenna 33. The actuating signal for the switch 39 is provided (along with control signals for each phase shifting element (not shown) making up the ferrite phase shifters 35 and the diode phase shifters 37) by the controller 24 (FIG. 1). The limiter 43 may be a limiter as shown in U.S. patent application Ser. No. 333,070, filed Apr. 3, 1989, which application is assigned to the same assignee as this application, or any other known type of limiter. Leakage signals passing through the switch 39 during transmission of any pulse of radio frequency energy are thereby prevented from being impressed on the amplifier 45.

The amplifier 45, which may be made up of several individual stages, is arranged to provide sufficient gain to received signals (whether echo signals or retransmitted signals) to counteract the insertion loss of the diode phase shifters 37 or any losses suffered by received signals in passing from the front antenna 31 to the first detector (not shown) in the receiver section of the transmitter/receiver 22 (FIG. 1). The pass band of the amplifier 45 is broad enough to cover any difference between the carrier frequencies of the interrogating pulses and retransmitted signals as well as any Doppler shift impressed on any echo signals or retransmitted signals. It will be noted here that the carrier frequencies of the retransmitted signals and command signals need not be, and usually are not, the same as the frequencies of the interrogating pulses or the echo signals. It follows then that the noise figure of a radar with an amplifier such as amplifier 45 is lower than the noise figure of a radar that does not incorporate an amplifier such as the amplifier 45. It will also be noted that the pass band of the ferrite phase shifters 35 need not be as wide as the pass band of the amplifiers 45 if the carrier frequency of the command signals is the same (or nearly the same) as the frequency of the interrogating pulses. It will still further be noted that the diode phase shifters 37 are reciprocal devices, even though the ferrite phase shifters 35 may be nonreciprocal devices, so the same control signals may be applied to both the ferrite phase shifters 35 and the diode phase shifters 37. That is to say, if a single feed (such as feed 20, FIG. 1) is used in both the transmitting mode and the receiving mode, the same control signals would be impressed on the ferrite phase shifters 35 and the diode phase shifters 37. On the other hand, if two (or more) feeds are used: (a) the control signals applied to the ferrite phase shifters 35 would be such as to collimate and direct radio frequency energy from a selected one of the feeds (which, of course, would be connected to the transmitter section of the transmitter/receiver 22 (FIG. 1)); and (b) the control signals applied to the diode phase shifters 37 would be such as to focus received radio frequency energy on the remaining feed, or feeds. It will be noted finally that the switch 39 (FIG. 2) may be replaced with a circulator similar to the circulator 41. Such replacement circulator would, of course, be arranged: (a) to pass radio frequency energy out of the ferrite phase shifters 35 (FIG. 2) to the front antenna 31; and (b) to pass radio frequency energy out of the front antenna 31 to the limiter 43 (FIG. 2).

Having described a preferred embodiment of this invention, it will now be apparent to one of skill in the art that changes may be made in space fed array antennas without departing from my inventive concept of using ferrite phase shifters when transmitting and diode phase shifters when receiving, with radio frequency amplification of received signals being effected to improve the noise figure of a radar. For example, the illustrated embodiment (wherein time multiplexing is used to permit a single beam to be scanned from a target to a missile) may be changed if a multibeam array antenna were used. In view of the foregoing, it is felt that this invention should not be restricted to its disclosed embodiment, but rather should be limited only by the spirit and scope of the appended claims.

What is claimed is:

1. A radar system comprising:

(a) means for providing a radar operative to transmit radio frequency energy originating at a first feed and to receive radio frequency energy at a second feed; and (b) a space fed array antenna including a plurality of antenna elements with each antenna element coupled to a first and a second radiating element with each element being responsive to radio frequency energy at said first and second feeds, each antenna element, comprising:

(i) a ferrite phase shifter adapted to shift the phase of radio frequency energy to be transmitted by an amount required to collimate and to direct such energy in a first direction;

(ii) a diode phase shifter adapted to shift the phase of received radio frequency energy to direct said received energy to the second feed;

(iii) amplifier means for amplifying received radio frequency energy to counteract, at least, the insertion losses of the diode phase shifter; and (iv) means, for connecting the ferrite phase shifter between the first and second radiating elements when radio frequency energy is to be transmitted and for isolating the amplifier means and the diode phase shifter from the transmitted radio frequency energy, and for connecting the amplifier means and the diode phase shifter between the first and second radiating elements and for isolating the ferrite phase shifter from the received radio frequency energy.

2. A radar system comprising:

(a) means for transmitting radio frequency (RF) energy originating at a first feed;

(b) means for receiving radio frequency energy at a second feed; and (c) a space fed array antenna comprising a plurality of array elements, each one of the array elements comprising:

(i) a first and a second radiating element;

(ii) first means, fed from the first radiating element, for providing a selected phase shift to transmitted radio frequency energy from the first feed for collimating and directing said transmitted RF energy at the second radiating element in a first direction;

(iii) second means, fed from the second radiating element, for providing a selected phase shift to received RF energy and for directing said received RF energy at the first radiating element toward the second feed;

(iv) means, disposed between the second radiating element and the second providing and directing means, for amplifying the received RF energy; and (v) means for connecting the first providing and directing means between the first and second radiating element and for isolating the second providing and directing means and the amplifying means from the transmitted RF energy when RF energy is being transmitted, and for connecting the amplifying means and the second providing and directing means between the first and second radiating elements and for isolating the first providing and directing means from the received RF energy when RF energy is being received.

3. A radar system as recited in claim 2 wherein the first means for providing and directing comprises a ferrite phase shifter.

4. A radar system as recited in claim 3 wherein the second means for providing and directing comprises a diode phase shifter.

5. An antenna element comprising:

(a) a first and a second radiating element;

(b) first means, fed from the first radiating element, for providing a selected phase shift to RF energy incident upon the first radiating element by an amount required for collimating and directing said RF energy at the second radiating element in a first direction;

(c) second means, fed from the second radiating element, for providing a selected phase shift to RF energy incident upon the second radiating element by an amount required for directing said RF energy toward a feed; and (d) means, disposed between the second radiating element and the second providing and directing means, for amplifying RF energy fed thereto; and (e) means for connecting the first providing and directing means between the first and second radiating element and isolating the amplifying means and second providing and directing means when in a transmitting mode and for connecting the amplifying means and the second providing and directing means between the first and second radiating elements and isolating the first providing and directing means when in a receiving mode.

6. An antenna element as recited in claim 5, wherein the first providing and directing means comprises a ferrite phase shifter.

7. An antenna element as recited in claim 6, wherein the second providing and directing means comprises a diode phase shifter.

* * * * *